US011066852B2

(12) United States Patent
Ichikawa

(10) Patent No.: US 11,066,852 B2
(45) Date of Patent: Jul. 20, 2021

(54) VEHICLE DOOR HANDLE DEVICE

(71) Applicant: ALPHA CORPORATION, Yokohama (JP)

(72) Inventor: Shinji Ichikawa, Yokohama (JP)

(73) Assignee: ALPHA CORPORATION, Yokohama (JP)

( * ) Notice: Subject to any disclaimer, the term of this patent is extended or adjusted under 35 U.S.C. 154(b) by 402 days.

(21) Appl. No.: 16/014,258

(22) Filed: Jun. 21, 2018

(65) Prior Publication Data

US 2018/0298650 A1 Oct. 18, 2018

Related U.S. Application Data

(63) Continuation of application No. PCT/JP2016/088149, filed on Dec. 21, 2016.

(30) Foreign Application Priority Data

Dec. 22, 2015 (JP) ..... 2015-249636

(51) Int. Cl.
*E05B 79/06* (2014.01)
*E05B 85/16* (2014.01)

(52) U.S. Cl.
CPC ..... *E05B 79/06* (2013.01); *E05B 85/16* (2013.01)

(58) Field of Classification Search
CPC ..... E05B 79/06; E05B 85/16; E05B 65/20
See application file for complete search history.

(56) References Cited

U.S. PATENT DOCUMENTS

| | | | |
|---|---|---|---|
| 2011/0042973 A1 | 2/2011 | Yoshino et al. | |
| 2015/0368936 A1 | 12/2015 | Chappuis et al. | |
| 2016/0032627 A1 | 2/2016 | Yoshino et al. | |

FOREIGN PATENT DOCUMENTS

| | | | |
|---|---|---|---|
| CN | U-204282956 | 4/2015 | |
| CN | U-204750045 | 11/2015 | |
| CN | U-204826942 | 12/2015 | |
| DE | 102012104775 A1 | 12/2013 | |
| EP | EP-2290176 A2 * | 3/2011 | ..... E05B 85/16 |
| JP | 2008-13961 A | 1/2008 | |
| JP | 2011-38371 A | 2/2011 | |
| JP | B2-5471921 | 2/2014 | |

OTHER PUBLICATIONS

Extended European Search Report dated Jun. 11, 2019 in corresponding European patent application 16878782.8 (7 pages).
CN Office Action dated Jul. 3, 2019 in Chinese Application No. 201680075635.5 (with attached English-language translation).
International Search Report dated Feb. 14, 2017 for PCT/JP2016/088149.
International Search Report and Written Opinion dated Feb. 14, 2017 for PCT/JP2016/088149 [non-English language].

* cited by examiner

*Primary Examiner* — Kristina R Fulton
*Assistant Examiner* — Thomas L Neubauer
(74) *Attorney, Agent, or Firm* — Faegre Drinker Biddle & Reath LLP

(57) ABSTRACT

A vehicle door handle device includes a handle base that is fixed to a door panel back surface of a vehicle, an operating handle that is linked to the handle base from a door front surface side to be rotatable around a rotation center, a stopper protrusion that is provided in any one of the operating handle and the handle base, and an engaged portion that is provided in the other one of the operating handle and the handle base.

9 Claims, 7 Drawing Sheets

VEHICLE DOOR HANDLE DEVICE

CROSS REFERENCE TO RELATED APPLICATIONS

This application is a continuation of PCT application No. PCT/JP2016/088149, which was filed on Dec. 21, 2016 based on Japanese Patent Application (No. 2015-249636) filed on Dec. 22, 2015, the contents of which are incorporated herein by reference.

TECHNICAL FIELD

The present invention relates to a vehicle door handle device.

BACKGROUND ART

Patent Literature 1 discloses a vehicle handle device that links an operating handle to a base along with a slide operation, the base being fixed to a door in advance.

In the vehicle handle device disclosed in Patent Literature 1, an abutting portion and an auxiliary stopper portion protrude from a distal end of the operating handle. In the base, a guide wall portion and an elastically deformable cantilevered depth side wall portion are provided.

In a case where the operating handle slides, the abutting portion abuts against the guide wall portion to press down the distal end of the operating handle. Due to the pressing, the depth side wall portion is elastically deformed such that a movement path of the abutting portion is opened. After the passage of the guide wall portion of the abutting portion, the depth side wall portion is elastically restored such that the abutting portion is locked to the guide wall portion. Next, the movement of the operating handle to the distal end side of rotation is restricted.

PRIOR ART LITERATURE

Patent Literature

[Patent Literature 1] JP-A-2008-013961

In the vehicle handle device disclosed in Patent Literature 1, during the slide operation for mounting of the operating handle, the abutting portion of the operating handle is pressed into the guide wall portion so as to be separated from amounting path to the guide wall portion side. As a result, it is necessary that a movement space of the operating handle used only for the mounting of the operating handle is set in the base, and the degree of freedom in layout is reduced.

SUMMARY OF THE INVENTION

In a vehicle door handle device according to an embodiment of the present invention, an operating handle can be linked to a handle base without requiring a surplus movement space for mounting of the operating handle.

According to an embodiment of the present invention, in a vehicle door handle device including an operating handle 2 that is linked to a handle base 1 from a door front surface side to be rotatable around a rotation center, the handle base being fixed to a door panel back surface of a vehicle, a stopper protrusion 3 is provided in any one of the operating handle 2 and the handle base 1, an engaged portion 4 is provided in the other thereof, the one of the operating handle and the handle base is elastically engaged with the other along with a sliding movement of the operating handle 2 to the rotation center side to restrict movement of the operating handle 2 to a distal end side of rotation, a hinge protrusion 5 is formed to protrude from an end portion of the operating handle 2 on the rotation center side, the handle base 1 is provided with a hinge restriction portion 8 which includes a top wall 6 for restricting movement of the hinge protrusion 5 in a door panel direction and an abutting wall 7 of the hinge protrusion 5, to which the hinge protrusion 5 abuts in an internally contact manner, and which has an inner center fitting to the rotation center of the operating handle 2 in the abutting state.

The door handle device includes: the handle base 1 that is fixed to the back surface of the door panel in advance; and the operating handle 2 that is linked to the handle base 1 from the front surface side of the door panel. The linking operation of the operating handle 2 is performed through the following steps: inserting one end of the operating handle 2 into the door through an opening formed in the door panel; and sliding the operating handle 2 to the rotation center side during the linking operation to the handle base 1 (in this specification, hereinafter, a state where the door handle device is mounted on the vehicle is set as a reference, a rotation center direction (in FIGS. 1A and 1B, the left) is set as "front side", a vehicle height direction (in FIG. 1A, a vertical direction) is set as "upper and lower sides", and a vehicle width direction (in FIG. 1B, a vertical direction) is set as "vehicle exterior side" and "interior side").

Along with the slide operation, the stopper protrusion 3 formed in one of the operating handle 2 and the handle base 1 elastically engages with the engaged portion 4 formed in the other one of the operating handle 2 and the handle base 1. In this engaged state, the movement of the operating handle 2 to the distal end side of rotation, that is, the rear side is restricted.

Since the rearward movement due to the engagement between the stopper protrusion 3 and the engaged portion 4 on the rotation center side is restricted, it is not necessary to dispose a stopper member at the rear end portion. Therefore, in a case where the operating handle 2 is operated, the generation of abnormal sound caused by sliding with the stopper member can be reliably prevented.

In addition, the engagement between the stopper protrusion 3 and the engaged portion 4 is performed by one of the stopper protrusion 3 and the engaged portion 4 being moved in an engaged and disengaged direction to elastically engage with the other one of the stopper protrusion 3 and the engaged portion 4 along with the forward movement of the operating handle 2. During this engagement operation, it is not necessary to move the operating handle 2 in a special direction. As a result, unlike the above-described example of the related art, it is not necessary that the movement space of the operating handle 2 for the engagement is set on the handle base 1, and a reduction in the degree of freedom in layout can be prevented.

Further, in a case where the hinge protrusion 5 protruding from the operating handle 2 is fitted into direct contact with the hinge restriction portion 8 of the handle base 1 such that the inner center of the hinge restriction portion 8 fits to the rotation center of the operating handle 2, when the operating handle 2 is operated to open the door, a pulling force in a door outside direction (vehicle exterior side) is applied to the rotation center by the hinge protrusion 5 and the top wall 6 of the hinge restriction portion 8 as illustrated in FIG. 7A. Therefore, a load on the stopper protrusion 3 can be reduced.

Further, when a pulling force (T) is applied rearward to the operating handle 2 in a state where the operating handle 2 is rotated by an appropriate angle (0) as illustrated in FIG.

7B, the movement to the vehicle exterior side is restricted by the top wall 6 of the hinge restriction portion 8. Therefore, only a horizontal force component (Th) is applied to the stopper protrusion 3 and the wall surfaces of the engaged portion 4. This horizontal force component (Th) is lower than the pulling force (T). Therefore, even in this case, a load on the stopper protrusion 3 is reduced.

The configuration where the stopper protrusion 3 and the engaged portion 4 engage with each other along with the forward movement of the operating handle 2 can be realized by adopting various structures. For example, in a configuration illustrated in FIG. 8A, the engaged portions 4 having an opening are provided in the cantilevered elastic wing pieces 10 that are elastically deformable around the supporting points 12, and the stopper protrusions 3 protrude from the operating handle 2. In this configuration, the elastic wing pieces 10 are elastically deformed along with the sliding movement of the operating handle 2 and then elastically engage with the engaged portions 4 due to an elastic restoring force of the elastic wing pieces 10. Alternatively, in a configuration illustrated in FIG. 8B, the stopper protrusions 3 may be provided on the elastic wing pieces 10 side.

In addition, in the above-described examples, the engaged portions 4 (FIG. 8A) or the stopper protrusions 3 (FIG. 8B) as the moving element formed in the elastic wing piece 10 is engaged with the receiving element which is the other one thereof. However, the moving element may be disposed on the operating handle 2 side. For example, the elastic wing pieces 10 may be provided in the operating handle 2, and the stopper protrusions 3 (refer to FIG. 9A) or the engaged portions 4 (refer to FIG. 9B) may be provided in the elastic wing pieces 10. Further, as illustrated in FIGS. 9C and 9D, the stopper protrusion 3 may be formed as a pin-shaped member that advances and retreats by being biased in a protruding direction by a spring 13.

In the embodiment of the present invention, a gap that keeps a non-contact state between the stopper protrusion 3 and the engaged portion 4 during a translational movement of the operating handle 2 to the outside of a door may be provided between the stopper protrusion 3 and the engaged portion 4.

According to this structure, in a case where an operating force for opening the door is applied to the operating handle 2 and a moving force to the outside of the door is applied to the rotation center portion of the operating handle 2, the gap formed between the stopper protrusion 3 and the engaged portion 4 absorbs the movement to the vehicle exterior side. As a result, when the operating handle 2 is operated to open the door, the entire load is applied to the top wall 6 of the hinge restriction portion 8 of the handle base 1. Therefore, a load generated during the operation is not applied to the stopper protrusion 3.

In the vehicle door handle device according to the embodiment of the present invention, the engaged portion 4 may be formed to have an opening. By forming the engaged portion 4 to have an opening, the structure can be simplified, careless disengaged of the stopper protrusion 3 from the engaged portion 4 can be completely prevented.

According to the embodiment of the present invention, the stopper protrusion 3 may be disposed at a rotation center position of the operating handle 2.

As illustrated in FIG. 7A, the stopper protrusion 3 may be disposed at a position distant from the rotation center of the operating handle 2, and the engaged portion 4 may be formed in an arc shape centering on the rotation center of the operating handle 2. However, in a case where the stopper protrusion 3 is disposed at the rotation center position of the operating handle 2, it is not necessary to take the movement path of the stopper protrusion 3 into consideration, and thus space-saving can be achieved.

According to the embodiment of the present invention, in a state where one of the stopper protrusion 3 and the engaged portion 4 as a moving element moving in an engaged and disengaged direction engages with the other one of the stopper protrusion 3 and the engaged portion 4 as a receiving element along with the sliding movement of the operating handle 2 to the rotation center side, in a press-contact portion between the moving element and the receiving element formed along with the sliding movement of the operating handle 2 to the distal end side of rotation, a line in the engaged and disengaged direction of the moving element is substantially perpendicular to an operation line of the operating handle 2 on the receiving element.

The engagement between the engaged portion 4 and the stopper protrusion 3 is performed by one (the moving element) of the engaged portion 4 and the stopper protrusion 3 being moved in the engaged and disengaged direction to engage with the other one (the receiving element) of the engaged portion 4 and the stopper protrusion 3 when the operating handle 2 slides forward. In a case where the operating handle 2 is pulled to the distal end side of rotation in the engaged state, the stopper protrusion 3 and the engaged portion 4 abut against each other such that the movement of the operating handle 2 is restricted.

In this state, in the abutting point, the line of the engaged and disengaged direction of the moving element is substantially perpendicular to the direction of the operation line of the operating force of the operating handle 2 on the distal end side of rotation. In this case, when the operating handle 2 is pulled rearward, the force component in the engaged and disengaged direction is not applied to the moving element. Therefore, even in a case where a user is strongly pulled the operating handle 2 rearward, the engaged state between the moving element and the receiving element, that is, between the stopper protrusion 3 and the engaged portion 4 is not released, and the reliability is improved.

According to the embodiment of the present invention, the stopper protrusion 3 may protrude from the operating handle 2, a cantilevered elastic wing piece 10 that is disposed along a slide operation direction of the operating handle 2 may be formed in the handle base 1, the elastic wing piece 10 may include a fixed end in an operation distal end direction during the slide operation of the operating handle 2 to the rotation center side, the elastic wing piece 10 may include a stopper abutting piece 9 at a free end, the elastic wing piece 10 may be elastically deformed to allow passage of the stopper protrusion 3 by the stopper protrusion 3 coming into press contact with the stopper abutting piece 9 during the sliding movement of the operating handle 2 to the rotation center side, and the engaged portion 4 may be formed in the elastic wing piece 10 and may engage with the stopper protrusion 3 due to an elastic restoration operation of the elastic wing piece 10 after the passage of the stopper protrusion 3.

In this case, in a case where the vehicle door handle device is configured such that an engagement releasing portion 11 that operates the elastic wing piece 10 to release the engagement of the engaged portion 4 extends from the stopper abutting piece 9, the operating handle 2 can be easily removed from the handle base 1.

According to the embodiment of the present invention, the operating handle does not move in a direction perpendicular to the sliding direction during the mounting. Therefore, during the mounting of the operating handle, it is not necessary to set a surplus movement space, and the internal space of the handle base can be effectively used.

BRIEF DESCRIPTION OF THE DRAWINGS

FIG. 5A is a diagram corresponding to FIG. 4A. FIG. 5B is a diagram illustrating a state where stopper protrusions abut against a stopper abutting piece. FIG. 5C is a diagram illustrating a state where elastic wing pieces are elastically deformed by the stopper protrusion. FIG. 5D is a diagram illustrating a state where an engaged portion is engaged with the stopper protrusion.

FIG. 6A is a cross-sectional view taken along line 6A-6A of FIG. 5D. FIG. 6B is a diagram corresponding to FIG. 6A illustrating a state where the operating handle is rotated. FIG. 6C is a diagram when seen in a direction indicated by arrow 6C of FIG. 5D. FIG. 6D is a diagram corresponding to FIG. 6C illustrating a state where the operating handle is rotated. FIG. 6E is a diagram when seen in a direction indicated by arrow 6E of FIG. 6C.

DESCRIPTION OF EMBODIMENTS

Figure 1A:
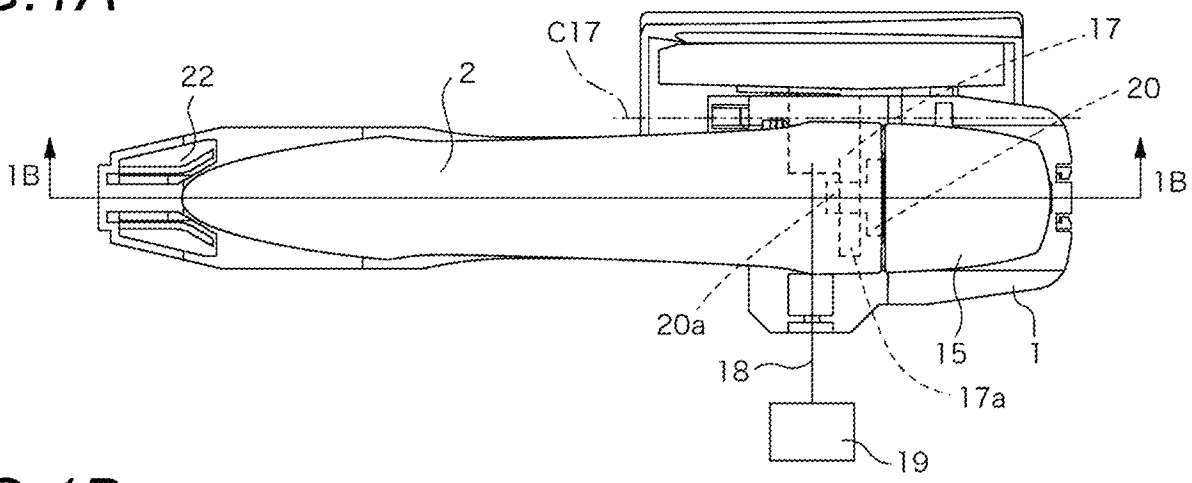
FIG. 1A is a front view illustrating a door handle device.
Figure 1B:
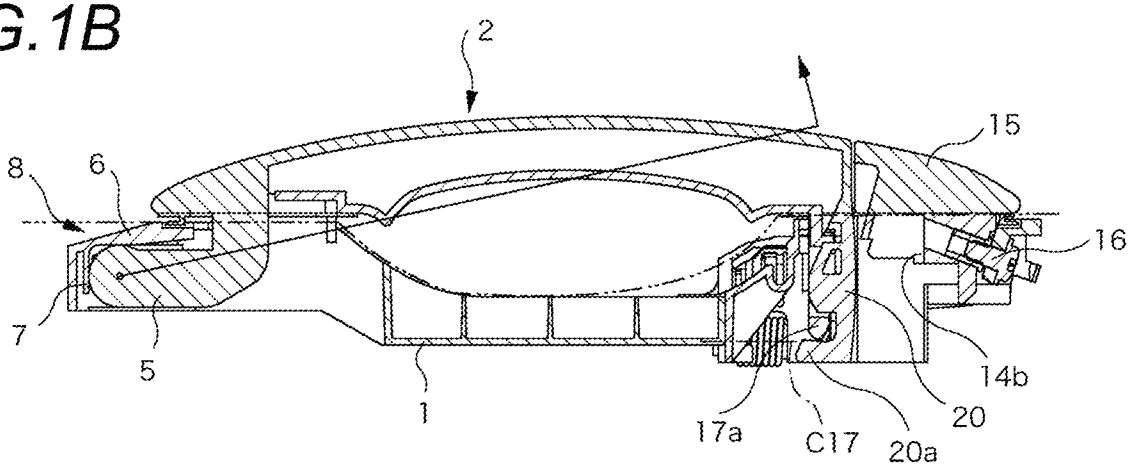
FIG. 1B is a cross-sectional view taken along line 1B-1B of FIG. 1A.

As illustrated in FIGS. 1A and 1B, a door handle device is formed by linking an operating handle 2 to a handle base 1. In order to prevent exposure to the outside of a vehicle, the handle base 1 is fixed to a back surface of a door panel (not illustrated), and the operating handle 2 is linked to the handle base 1 from the outside of the vehicle after the mounting of the handle base 1 to the vehicle.

In order to block a rear opening 14*b* that is formed in the handle base 1 described below, a cap member 15 is fixed to the handle base 1 through a bolt 16.

An activation lever 17 is linked to a rear end portion of the handle base 1 so as to be rotatable around a rotation axis (C17). Accordingly, the handle base 1 transmits the rotation of the activation lever 17 to a door lock device 19 through a cable device 18 and the like to operate the door lock device 19, the door lock device 19 keeping a closed state of the door.

Figure 2:
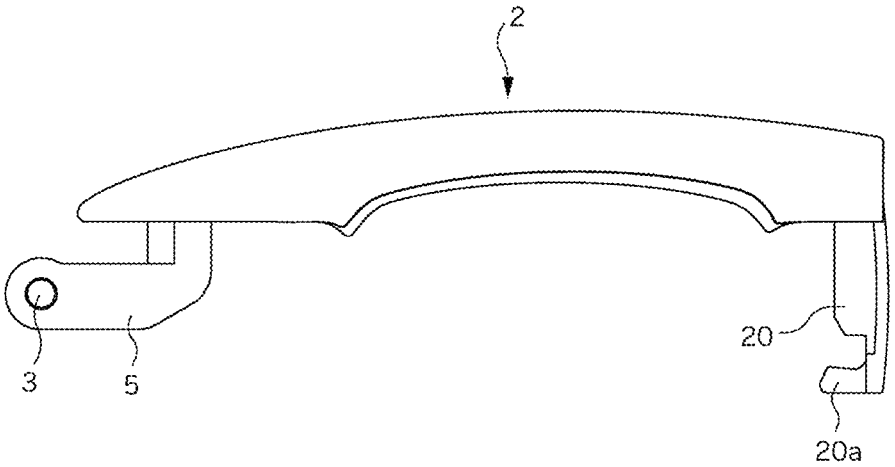
FIG. 2 is a plan view illustrating an operating handle.

On the other hand, as illustrated in FIG. 2, the operating handle 2 includes a hinge protrusion 5 at a front end and includes an activation leg 20 at a rear end. In the linked state, the operating handle 2 rotates around the center of the hinge protrusion 5 as a rotation center. In the state where the operating handle 2 is linked to the handle base 1, as illustrated in FIG. 1E, a locking step portion 20*a* that protrudes forward from a free end of the activation leg 20 is locked to a locking rod 17*a* that protrudes from the activation lever 17, and the activation lever 17 rotates along with the rotation of the operating handle 2.

Figure 4A:
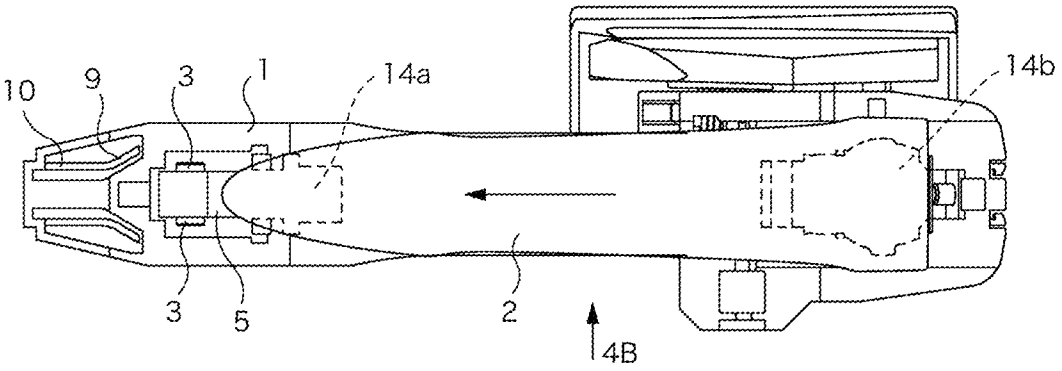
FIG. 4A is a front view illustrating a linking operation of the operating handle.
Figure 4B:
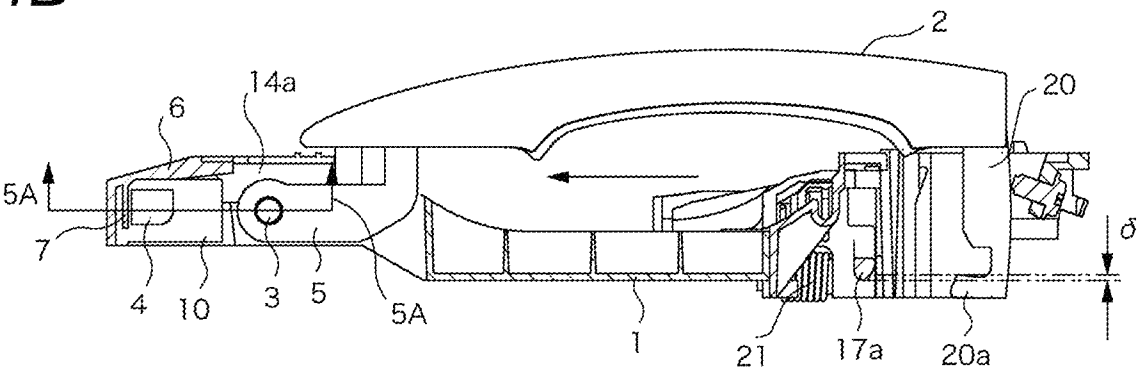
FIG. 4B is a diagram when seen in a direction indicated by arrow 4B of FIG. 4A.

The mounting of the operating handle 2 to the handle base 1 is performed as illustrated in FIGS. 4A and 4B through the following steps: inserting the hinge protrusion 5 and the activation leg 20 of the operating handle 2 into the door through front and rear openings 14*a* and 14*b* provided in the handle base 1 and front and rear openings (not illustrated) of the door panel; and sliding the entire portion of the operating handle 2 forward in a direction indicated by an arrow of FIGS. 4A and 4B.

In a state where the operating handle 2 is set as illustrated in FIG. 4B, a vehicle exterior surface of the locking step portion 20*a* is positioned on a vehicle exterior side from an interior surface of the locking rod 17*a* (process gap δ), and the locking rod 17*a* temporarily rotates against a biasing force of a torsion spring 21 due to the forward slide operation of the operating handle 2 to allow the passage of the locking step portion 20*a*, and then comes into press contact with the locking step portion 20*a*. In this state, the locking step portion 20*a* is pressed to the interior side such that rattling is prevented. Further, the locking step portion 20*a* moves outward due to the rotation of the operating handle 2 such that the activation lever 17 rotates.

In addition, a front end surface of the hinge protrusion 5 of the operating handle 2 is formed of an arc-shaped surface, and cylindrical stopper protrusions 3 protrude from upper and lower surfaces of the hinge protrusion 5 in a center position of the arc-shaped surface. Further, in a front end portion of the handle base 1, cantilevered elastic wing pieces 10 including a front end that is a fixed end are formed.

Figure 3A:
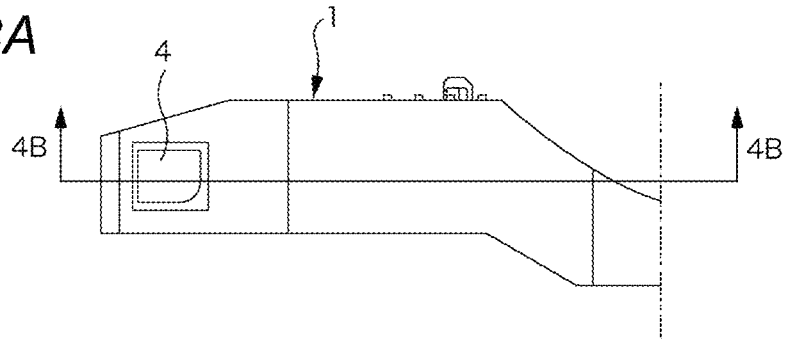
FIG. 3A is a plan view illustrating a distal end portion of a handle base.
Figure 3B:
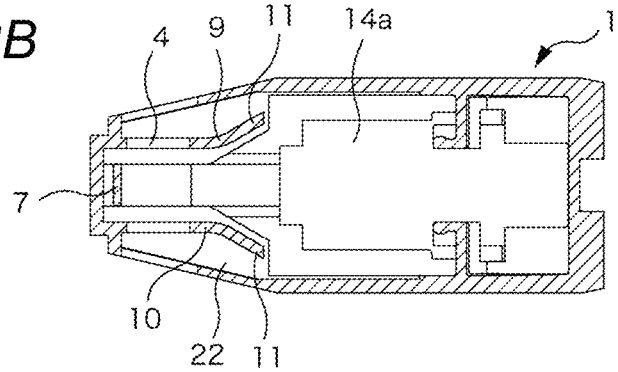
FIG. 3B is a cross-sectional view taken along line 3B-3B of FIG. 3A.
Figure 5A:
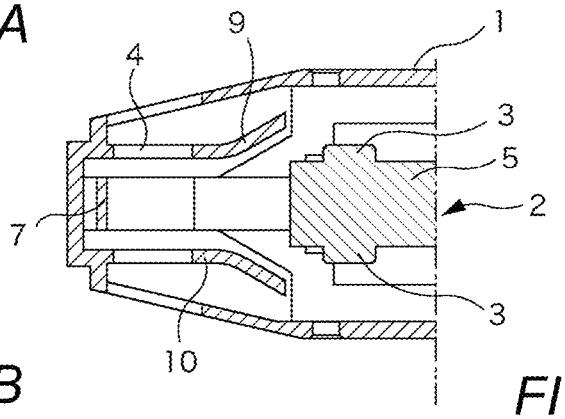
FIGS. 5A to 5D are cross-sectional views taken along line 5A-5A of FIG. 4B illustrating the linking operation of the operating handle.
Figure 5B:
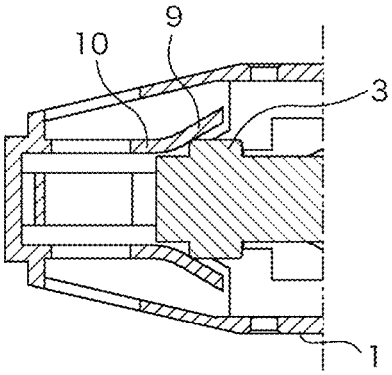
Figure 5C:
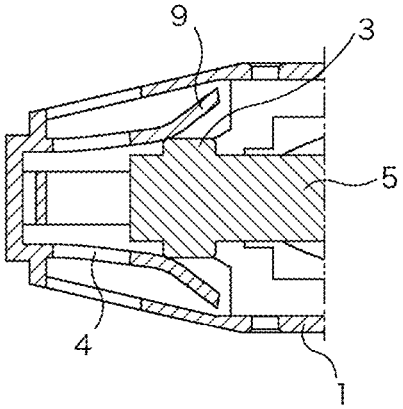
Figure 5D:
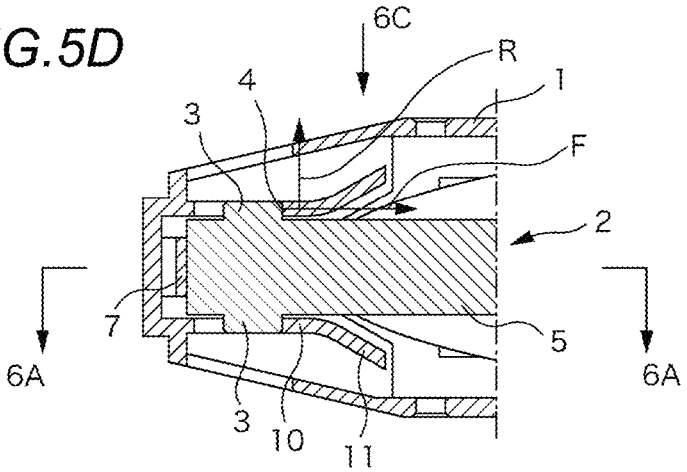

As illustrated in FIGS. 3B, and 5A, to 5D, two elastic wing pieces 10 are disposed in parallel at substantially same intervals in a vertical direction of the hinge protrusion 5 of the operating handle 2, and stopper abutting pieces 9 are formed by bending respective free ends of the elastic wing pieces 10 in a trailing direction.

In addition, as illustrated in FIG. 3A, an engaged portion 4 is provided in each of the elastic wing pieces 10. The engaged portions 4 are openings that have a curved portion having the same diameter as the stopper protrusions 3 of the operating handle 2 at one corner, and an interval between an interior side edge and an exterior side edge and an interval between front and rear side edges are larger than the diameter of the stopper protrusions 3.

Accordingly, in this example, in a state where the operating handle 2 is set as illustrated in FIG. 5A, the stopper abutting pieces 9 of the elastic wing pieces 10 are positioned on a movement path of the stopper protrusions 3 of the operating handle 2. In a case where the operating handle 2 slides forward from the above-described state, the stopper protrusions 3 abut against the stopper abutting pieces 9 as illustrated in FIG. 5B.

Next, in a case where the operating handle 2 further slides, as illustrated in FIG. 5C, the opposite elastic wing pieces 10 are elastically deformed so as to retreat by the respective stopper protrusions 3 to allow the passage of the stopper protrusions 3. Next, in a case where the stopper protrusions 3 are positioned at positions corresponding to the engaged portions 4, the opposite elastic wing pieces 10 are elastically restored such that the engaged portions 4 as a moving element elastically engage with the stopper protrusions 3 as a receiving element as illustrated in FIG. 5D.

In a state where the stopper protrusions 3 are fitted to the engaged portions 4, the rearward movement of the stopper protrusions 3, that is, the operating handle 2 is restricted by peripheral walls of the engaged portions 4. In this state, as illustrated in FIG. 1B, an appropriate clearance is secured between a rear end surface of the activation leg 20 of the operating handle 2 and the cap member 15. Thus, in a state where the operating handle 2 rotates, sliding with the cap member 15 is reliably prevented.

In addition, when the operating handle 2 is pulled rearward in a state where the stopper protrusions 3 are fitted to the engaged portions 4, a force is applied to the elastic wing pieces 10 in a direction indicated by arrow F in FIG. 5D. On the other hand, this force is perpendicular to a direction (a direction indicated by arrow R in FIG. 5D) in which the engagement between the stopper protrusions 3 and the cantilevered elastic wing pieces 10 that extend rearward from the respective fixed ends is released. Therefore, even in a case where the pulling force indicated by arrow F is applied to the operating handle 2, the force component in the direction indicated by arrow R is not applied to the elastic wing pieces 10, and the engagement between the stopper protrusions 3 and the engaged portions 4 is not released carelessly during the operation of the operating handle 2.

In addition, in the example, in a case where the portions where the stopper protrusions 3 and the engaged portions 4 are engaged with each other are configured to be perpendicular to arrow F as illustrated in FIG. 5D, even when the pulling force in the direction indicated by arrow F is applied to the operating handle 2, the force component in the direction indicated by arrow R is not generated. The portions where the stopper protrusions 3 and the engaged portions 4 are engaged with each other can be arbitrarily configured to be in line contact or surface contact with each other.

Further, supporting points 12 that are fixed ends of the cantilevered elastic wing pieces 10, and the portions where the stopper protrusions 3 and the engaged portions 4 are engaged with each other may be configured to be on the same straight line in the direction (arrow F) of the force generated by pulling the operating handle 2 rearward such that the force component (arrow R) in the direction in which the engagement between the elastic wing pieces 10 and the stopper protrusions 3 is released is not generated.

Further, in a state where the stopper protrusions 3 are fitted to the engaged portions 4 as illustrated in FIGS. 6A to 6E, the hinge protrusion 5 abuts against a hinge restriction portion 8 that is formed in the handle base 1. The hinge restriction portion 8 includes a top wall 6 and an abutting wall 7. In a state where the arc-shaped surface of the hinge protrusion 5 abuts against the abutting wall 7, the movement of the entire portion of the operating handle 2 to the interior side is restricted by the door panel. Concurrently, the arc-shaped surface abuts into direct contact with the top wall 6 in an internally contact manner, and an inner center of the hinge protrusion 5 provides a rotation center during the rotation of the operating handle 2.

In addition, in the example, the abutting wall 7 of the hinge restriction portion 8 is formed to be in an elastically deformable cantilever shape, and is in press contact with a distal end of the hinge protrusion 5 in a state where the operating handle 2 is linked to the handle base 1. As a result, a biasing force is applied to the operating handle 2 by the abutting wall 7, and thus the stopper protrusions 3 and the engaged portions 4 are in press contact with each other and rattling of the operating handle 2 is prevented.

Figure 6A:
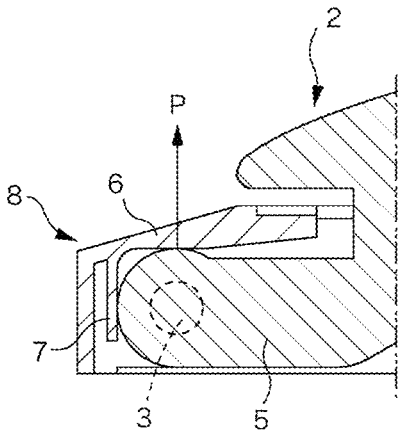
FIGS. 6A to 6E are diagrams illustrating a state where the operating handle is linked to the handle base.
Figure 6B:
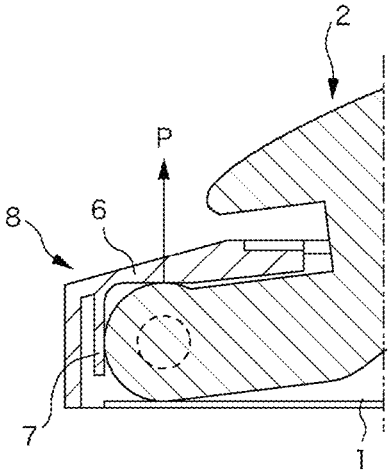
Figure 6C:
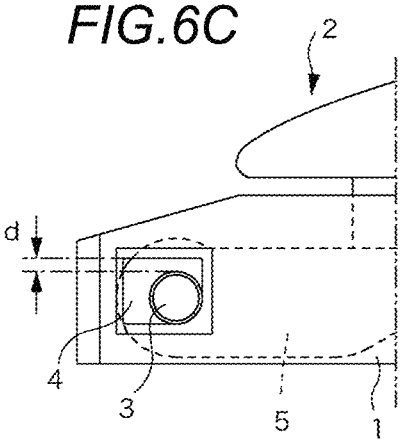
Figure 6D:
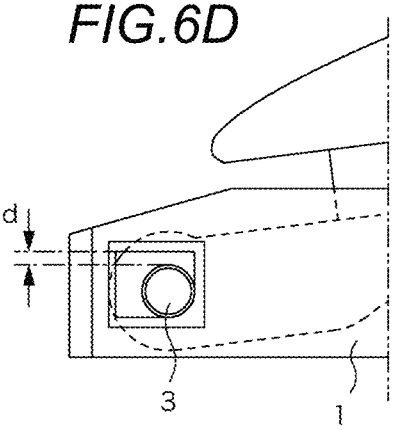

Further, in a case where the operating handle 2 is operated to open the door, an operating force (P) of the operating handle 2 functions as a force of pressing the hinge restriction portion 8 of the hinge protrusion 5 to the top wall 6 as illustrated in FIGS. 6A and 6B. On the other hand, in the top wall 6 of the hinge restriction portion 8, upper and lower edges are linked to upper and lower wall surfaces of a distal end portion of the handle base 1, and a front end edge is linked to a front end wall surface of the handle base 1. As a result, the top wall 6 has high rigidity and strength. In addition, since a clearance d is set between the stopper protrusions 3 and inner peripheral wall surfaces of the engaged portions 4, the operating force (P) is not applied to the stopper protrusions 3. Therefore, the strength can be improved during the operation of the operating handle 2.

Figure 6E:
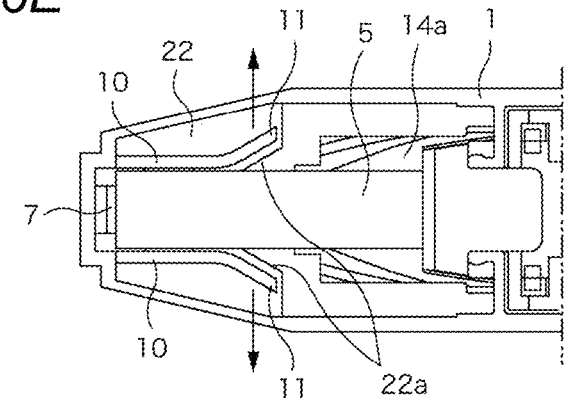
Figure 7A:
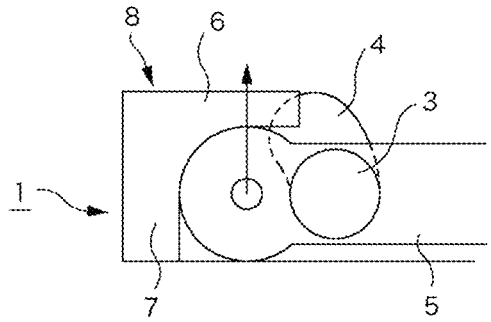
FIG. 7A is a diagram illustrating a state where the operating handle is positioned in an initial rotation position.
Figure 7B:
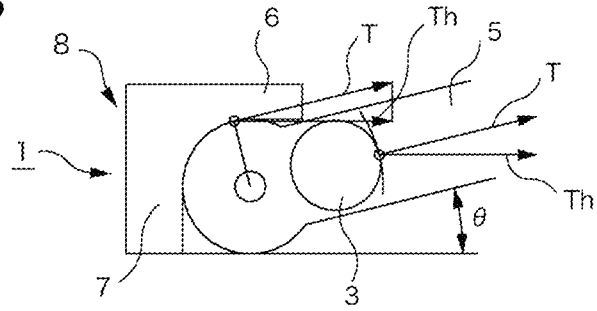
FIG. 7B is a diagram illustrating a state where the operating handle is rotated by a predetermined angle.
Figure 8A:
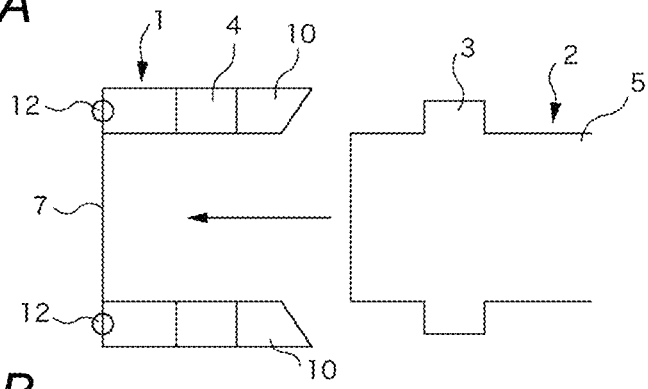
FIGS. 8A and 8B are diagrams illustrating a relationship between the stopper protrusions and the engaged portion.
Figure 8B:
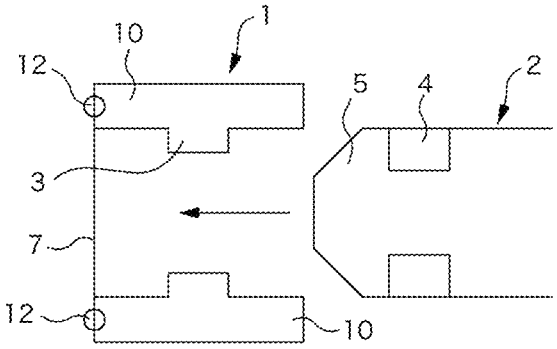
Figure 9A:
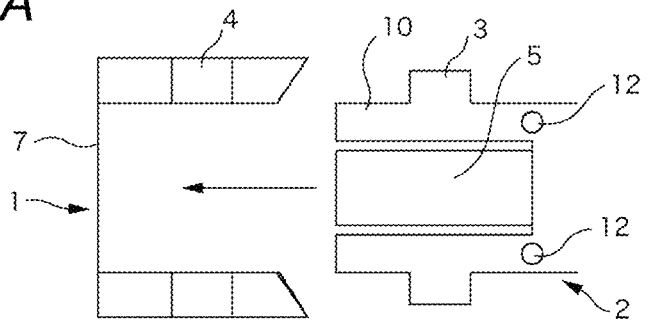
FIGS. 9A to 9D are diagrams illustrating another example of a relationship between the stopper protrusions and the engaged portion.
Figure 9B:
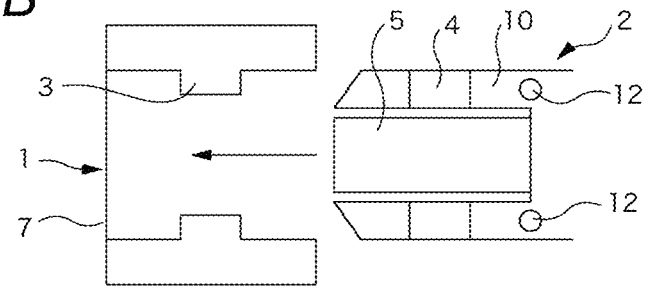
Figure 9C:
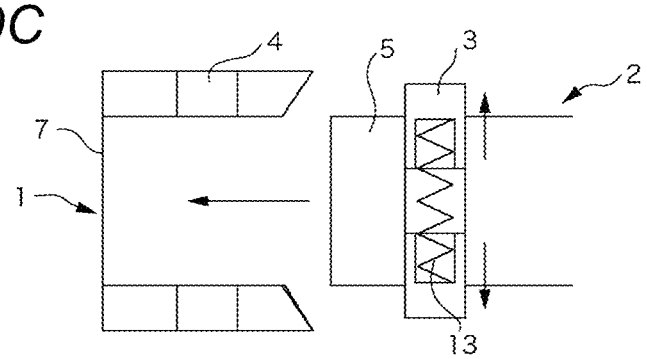
Figure 9D:
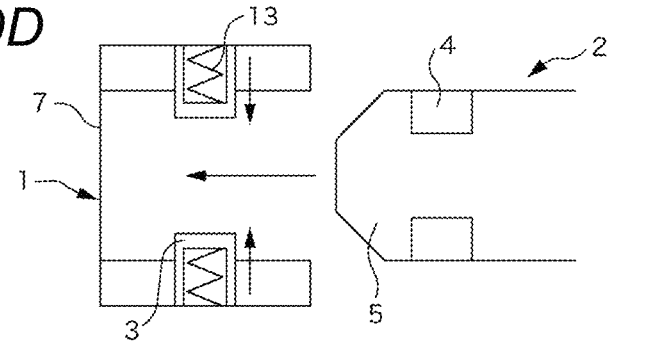

Further, in a state where the door panel is fixed to the handle device as illustrated in FIG. 6E, engagement releasing portions 11 are exposed from the door panel back surface. Therefore, by operating the engagement releasing portions 11 in directions indicated by arrows, the operating handle 2 can be easily removed from the handle base 1.

In this case, in a case where an exposure opening 22 from which the elastic wing pieces 10 are exposed to the vehicle exterior side is provided in the handle base 1 and overhang sides 22*a* are provided in the exposure opening 22 as illustrated in FIG. 6E, the operating handle 2 can be simply removed by directly inserting fingers into gaps between the overhang sides and the engagement releasing portions 11.

REFERENCE SIGNS LIST

1: Handle base
2: Operating handle
3: Stopper protrusion
4: Engaged portion
5: Hinge protrusion
6: Top wall
7: Abutting wall
8: Hinge restriction portion
9: Stopper abutting piece
10: Elastic wing piece
11: Engagement releasing portion

The invention claimed is:

1. A vehicle door handle device comprising:

a handle base that is fixed to a door panel back surface of a vehicle;

an operating handle that is linked to the handle base from a door front surface side to be rotatable around a rotation center;

a stopper protrusion that is provided in any one of the operating handle and the handle base; and an engaged portion that is provided in the other one of the operating handle and the handle base, wherein along with sliding of the operating handle to a rotation center side, the stopper protrusion and the engaged portion are elastically engaged with each other so that movement of the operating handle to a rotation distal end side is restricted, wherein a hinge protrusion protrudes from an end portion of the operating handle on the rotation center side, wherein the handle base includes a hinge restriction portion, wherein the hinge restriction portion includes a top wall restricting movement of the hinge protrusion in a door panel direction and an abutting wall of the hinge protrusion, wherein the hinge protrusion abuts into the hinge restriction portion in an internally contact manner, wherein in a state that the hinge protrusion abuts against the hinge restriction portion, an inner center of the hinge restriction portion fits to the rotation center of the operating handle, wherein a gap that keeps a non-contact state of the stopper protrusion and the engaged portion during a translational movement of the operating handle to outside of a door is provided between the stopper protrusion and the engaged portion, and wherein when an operating force for opening the door is applied to the operating handle and a moving force to the outside of the door is applied to the rotation center of the operating handle, the gap absorbs the movement force.

2. The vehicle door handle device according to claim 1, wherein the engaged portion is formed to have an opening.

3. The vehicle door handle device according to claim 1, wherein the stopper protrusion is positioned at the rotation center of the operating handle.

4. The vehicle door handle device according to claim 1, wherein in a state that one of the stopper protrusion and the engaged portion as a moving element moving in an engaged and disengaged direction, engages with the other one of the stopper protrusion and the engaged portion as a receiving element along with a sliding movement of the operating handle to the rotation center side, in a press-contact portion between the moving element and the receiving element along with the sliding of the operating handle to the rotation center side, the engaged and disengaged direction of the moving element is substantially perpendicular to an operation line direction of the operating handle on the receiving element in an engagement releasing direction.

5. The vehicle door handle device according to claim 1, wherein the stopper protrusion protrudes from the operating handle, wherein an elastic wing piece that is cantilevered and positioned along a sliding operation direction of the operating handle is formed in the handle base, wherein the elastic wing piece includes a fixed end in an operation distal end direction during a slide operation of the operating handle to the rotation center side, wherein the elastic wing piece includes a stopper abutting piece at a free end, wherein the stopper protrusion presses and contacts to the stopper abutting piece during the sliding movement of the operating handle to the rotation center side and the elastic wing piece is elastically deformed to allow passage of the stopper protrusion, and wherein the engaged portion is formed in the elastic wing piece and elastically engages with the stopper protrusion due to an elastic restoration operation of the elastic wing piece after the passage of the stopper protrusion.

6. The vehicle door handle device according to claim 5, wherein an engagement releasing portion in which the elastic wing piece is operated to release an engagement of the engaged portion, extends from the stopper abutting piece.

7. The vehicle door handle device according to claim 1, wherein the top wall includes upper and lower edges that are linked to upper and lower wall surfaces of a distal end portion of the handle base, and wherein the top wall includes a front end edge that is linked to a front end wall surface of the handle base.

8. The vehicle door handle device according to claim 1, wherein the stopper protrusion is formed as a pin-shaped member that advances and retreats by being biased in a protruding direction by a spring.

9. The vehicle door handle device according to claim 1, wherein the gap softens an impact force to the outside of the door.

* * * * *